United States Patent [19]

MacNitt, Jr.

[11] 3,986,821

[45] Oct. 19, 1976

[54] APPARATUS FOR CONVEYING PARTICULATE MATTER THROUGH A FURNACE

[75] Inventor: Donald G. MacNitt, Jr., North Palm Beach, Fla.

[73] Assignee: United Technologies Corporation, Hartford, Conn.

[22] Filed: Dec. 4, 1975

[21] Appl. No.: 637,622

[52] U.S. Cl. ..... 432/112; 432/118

[51] Int. Cl.[2] ..... F27B 7/08; F27B 7/14

[58] Field of Search ..... 432/112, 113, 114, 118

[56] References Cited

UNITED STATES PATENTS

| | | | |
|---|---|---|---|
| 1,686,565 | 10/1928 | Knapp | 432/112 |
| 1,820,668 | 8/1931 | Lobley | 432/112 |
| 2,071,534 | 2/1937 | Ingraham | 432/113 |
| 2,240,757 | 5/1941 | Buck | 432/112 |
| 3,144,245 | 8/1964 | Martin | 432/112 |

*Primary Examiner*—John J. Camby

*Attorney, Agent, or Firm*—Charles A. Warren

[57] ABSTRACT

Apparatus for supporting a conveyor tube in a furnace for rotation so as to translate particulate matter axially along the tube, and for axial movement of the tube to withdraw it from a device into which the particulate material is delivered from the tube.

12 Claims, 5 Drawing Figures

APPARATUS FOR CONVEYING PARTICULATE MATTER THROUGH A FURNACE

SUMMARY OF THE INVENTION

One feature of the invention is a conveyor tube for use within a furnace associated with a compacting press, the tube being rotatable and serving to deliver particulate material along the axis of the tube for heating the material before delivery from the tube into a container in a press the latter serving to compact the particulate material. Another feature is an arrangement for axial movement of the conveyor tube to withdraw it from the press so that the latter may be operated.

According to this invention, a conveyor tube is supported at opposite ends with the axis of the tube making a small angle with the horizontal, this slant of the tube assisting axial movement of the particulate matter through the tube in combination with a helical rib on the inner surface of the tube. A carriage at the inlet end of the tube guides the axial movement of the tube and carries with it the funnel by which the particulate matter is guided into the tube.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figures 1, 2, 3, 4, 5:
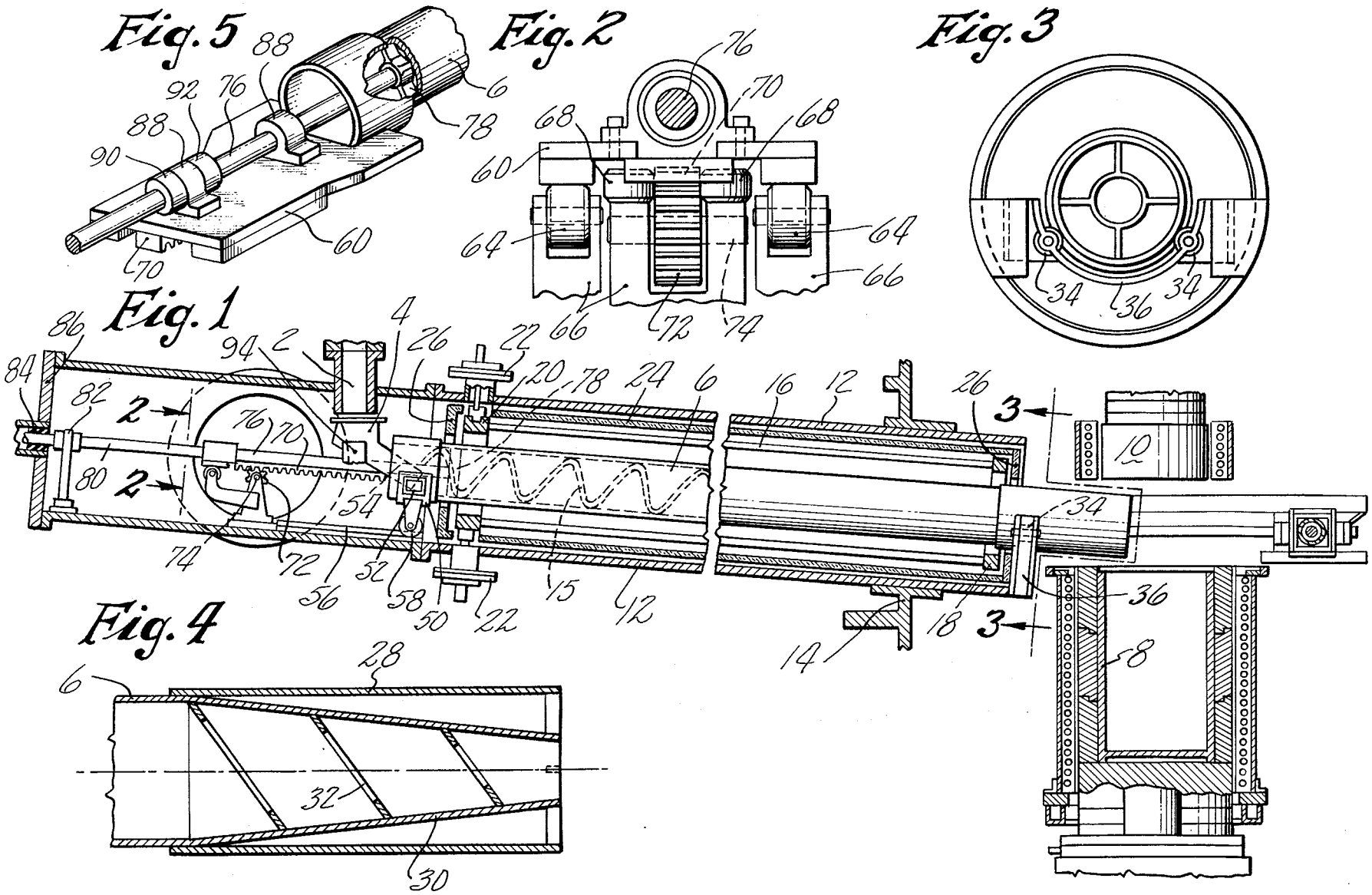
FIG. 1 is a vertical sectional view through a device embodying the invention.
FIG. 2 is a sectional view along line 2—2 of FIG. 1.
FIG. 3 is a view along line 3—3 of FIG. 1.
FIG. 4 is a sectional view through the delivery end of the conveyor tube.
FIG. 5 is a perspective view of the carriage.

The invention is adapted for receiving particulate matter at a predetermined rate through a delivery spout 2 from which a funnel 4 guides it into the tube 6. The delivery end of the tube drops the particulate matter into a container 8 on a compacting press, the ram 10 of which is intermittently moved down to compact the material in the container. An apparatus for delivering the material to spout 2 and the compacting press are more fully described in the copending application of Jerry A. King et al., U.S. Ser. No. 637,624, filed Dec. 4, 1975 and having the same assignee as this application. For the purpose of this application it may be noted that the movement of the ram requires that the conveyor tube be withdrawn from alignment with the ram and this is a part of the present invention.

The conveyor tube is positioned within an enclosure 12 which has a tight engagement with the spout 2 and with the wall 14 of the press enclosure, otherwise not shown, so that the apparatus may operate in a vacuum.

The tube 6 has a helical rib 15 on its inner surface to assist in feeding the particulate material through the tube and into the container. This movement of the material is at such a rate that the material may be heated to and heat treated at the appropriate temperature and for the necessary time before discharging from the delivery end of the tube. To accomplish the heating, the tube is surrounded by a plurality of parallel heating rods 16, such as carbon, which extend parallel to the tube in spaced relation thereto. These rods are interconnected adjacent the lower end of the tube by a support ring 18 and at the upper end by connecting ring 120. Power input to these rods is from terminals 22 mounted in the wall of the enclosure 12. The cluster of rods forms a cylindrically arranged heater.

The cluster of rods 16 is surrounded, in spaced relation thereto, by a cylinder 24 of insulating material, this cylinder being witin and also spaced from the wall of the enclosure 12. End caps 26 close the ends of the cylinder and have central openings to receive the conveyor tube with clearance around the tube to permit both rotational and axial movement of the tube.

The downstream end of the tube 6 has a cylindrical extension 28, FIG. 4, surrounding the tapering end 30 of the tube. This tapering end has a spiral rib 32 therein forming in effect an extension of the rib 15. The extension 28 and thus the delivery end of the tube is supported by rollers 34 in a yoke 36 mounted on the end of the enclosure 12. These rollers permit rotation of the conveyor tube during delivery of material to the compacting container. These rollers also permit axial movement of the tube past the rollers since the tube is rotating as it is moved axially.

At the upstream end of the conveyor tube a similar yoke 50 carries rollers 52 engaging a cylindrical end 54 on the tube. This yoke is supported on a track 56 by a roller 58 for movement with the tube as it is moved axially. This yoke is a part of a carriage 60, FIG. 2, supported on rollers 64 on a bracket 66 mounted on the enclosure 12. In addition to the supporting rollers 64 the bracket carries vertically positioned rollers 68 which engage on opposite sides of a rack 70 mounted on the carriage. This rack is engaged by a driving pinion 72 by which the tube is moved axially. Suitable driving means for the pinion are provided such as a reversible motor connected to the pinion shaft 74 by a reduction gear, not shown.

The carriage also carries bearings for the tube drive sleeve or hollow shaft 76 which is connected to the conveyor tube by a spider 78 within the tube. Sleeve 76 telescopes with a concentric drive shaft 80 journaled in a bearing 82 and passing through a seal 84 in the cap 86 on the enclosure 12. Suitable bearings 88, FIG. 4, on the carriage support the sleeve 76 and collars 90 and 92 on the sleeve assure axial movement of the sleeve with the carriage to transport the tube 6 with the carriage.

The funnel 4 is supported on the carriage 60 as by a bracket 94. The funnel may be bifurcated as shown to straddle the sleeve 76 for depositing the particulate material in the tube. Obviously the funnel inlet is vertically spaced below the spout 2 so that lateral movement of the funnel below the spout is possible when the carriage and tube are moved endwise.

In operation, the furnace, which includes the heating rods and the surrounding insulation, is started and particulate material is deposited through the spout 2 and funnel 4 into the rotating conveyor tube. The particulate material is carried through the tube as a result of the tube rotation and is deposited in the container 8. When this container is full the supply of material to the spout is cut off, the conveyor tube is retracted, its rotation stopped, and the ram 10 moved down to compact the particulate material in the container. The ram is then raised, the tube advanced to the position shown and additional material supplied through the spout and advanced through the conveyor tube to the container.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desired to secure by Letters Patent of the United States is:

1. Apparatus for conveying particulate material through a furnace including:

a substantially cylindrical tube adapted to be positioned in the furnace and having inlet and discharge ends, support means for the discharge end for rotary and axial movement of the tube, a carriage at the inlet end of the tube on which the tube is supported for rotation, drive means for the tube including a shaft journaled in the carriage, means for supporting the tube to move with the carriage, and guide means for the carriage parallel to the tube axis.

2. Apparatus as in claim 1 in which the support means includes a yoke and a plurality of rollers on the yoke engaging with the periphery of the tube.

3. Apparatus as in claim 1 including a funnel mounted on the carriage to receive particulate material and guide it into the tube.

4. Apparatus as in claim 2 in which the rollers are on axes parallel to the tube axis.

5. Apparatus as in claim 1 including an enclosure for the tube and carriage, with the carriage guide means supported within the enclosure.

6. Apparatus as in claim 1 in which the tube is at an acute angle to the horizontal to facilitate movement of particulate material through the tube.

7. Apparatus for treating particulate material including:

an enclosure for a furnace, having a spout for particulate material in the wall thereof, a cylindrically arranged heater within the enclosure, a tube extending through the heater for conveying particulate matter therethrough, said tube having inlet and discharge ends, a funnel at the inlet end of the tube to receive material from the spout, a carriage mounted on the inside of the enclosure and supporting the inlet end of the tube for rotation, said carriage also supporting the funnel, support means at the discharge end of the tube for rotary and axial movement of the tube therein, means for moving the carriage within the enclosure parallel to the axis of the tube for withdrawing the tube axially relative to the furnace, and a drive shaft for the tube, journaled in the carriage.

8. Apparatus as in claim 7 including a positioning of the enclosure, heater and tube so that the tube axis makes an acute angle with the horizontal.

9. Apparatus as in claim 7 in which the support means is a yoke at the end of the heater and carrying rollers engaging with the periphery of the tube adjacent the discharge end.

10. Apparatus as in claim 7 in which the carriage has supporting rollers engaging the periphery of the tube adjacent the inlet end, and bearings for the drive shaft.

11. Apparatus as in claim 7 including a rack on the carriage and a pinion journaled in a bracket on the enclosure by which to move the carriage and tube.

12. Apparatus as in claim 7 including a bracket mounted on the inside of the enclosure, said bracket having rollers for supporting the carriage and other guide rollers to guide the carriage movement along a line parallel to the tube axis.

* * * * *